US005522504A

United States Patent [19]

Levi

[11] Patent Number: 5,522,504

[45] Date of Patent: Jun. 4, 1996

[54] BOX CONSTRUCTION HAVING SPRING ENGAGEMENT

[75] Inventor: Hans L. Levi, Seattle, Wash.

[73] Assignee: Baldwin Technology Corporation, Rosemont, Ill.

[21] Appl. No.: 396,597

[22] Filed: Mar. 1, 1995

[51] Int. Cl.[6] ..... A45F 5/12; B65D 85/14; B31B 1/26

[52] U.S. Cl. ..... 206/424; 206/592; 229/103.2; 229/168; 493/162

[58] Field of Search ..... 229/168, 103.2; 206/424, 586, 591, 592; 493/162

[56] References Cited

U.S. PATENT DOCUMENTS

| | | | |
|---|---|---|---|
| 3,261,537 | 7/1966 | Kistner | 229/103.2 |
| 3,263,897 | 8/1966 | Giroux | 229/103.2 |
| 3,325,964 | 6/1967 | Boitel | 206/424 X |
| 3,368,735 | 2/1968 | Levi | 206/424 |
| 3,465,946 | 9/1969 | Johnson | 206/424 X |
| 3,516,593 | 6/1970 | Larsen | 206/424 |
| 3,666,168 | 5/1972 | Partain et al. | 206/586 |
| 3,820,708 | 6/1974 | Sieffert | 206/592 X |
| 3,836,066 | 9/1974 | Del Priore et al. | 206/424 X |
| 3,861,580 | 1/1975 | Sieffert | 206/586 X |
| 4,171,742 | 10/1979 | Kohayakawa et al. | 206/424 X |

*Primary Examiner*—Bryon P. Gehman
*Attorney, Agent, or Firm*—Richard S. Roberts

[57] ABSTRACT

Corrugated box constructions suitable for packaging, storing and transporting flat rectangular objects such as books and the like. The box has a generally rectangular central panel, a pair of side panels hingedly joined to one of the opposite ends of the central panel. The side panels fold first perpendicularly and then parallel to the central panel and have a leaf-spring terminus. A top panel is hingedly joined to one of the transverse sides of the central panel. The top panel folds first perpendicularly upward, then parallel, then perpendicularly downward and under the central panel. The construction allows for packaging products of various sizes and yet provides a cushioned retention of the product without changing the carton size.

16 Claims, 3 Drawing Sheets

BOX CONSTRUCTION HAVING SPRING ENGAGEMENT

BACKGROUND OF THE INVENTION

1. Field of the Invention

The present invention relates to box constructions, or more particularly to corrugated box constructions suitable for packaging, storing and transporting flat rectangular objects such as books and the like.

2. Description of the Prior Art

It is well known in the art to produce shipping and storage boxes in a wide variety of sizes and shapes. The most common is a hollow, six sided cubic or three dimensional rectangular structure having corrugated cardboard side walls as well as top and bottom closures. It is also well known in the art to provide storage and shipping boxes for printed materials such as books and the like. It has been a disadvantage in the book packaging industry to provide means for wrapping books of varying sizes. Typically, an individual box size is needed for the dimensions of a given book. Clearly a book which is too large for its packaging either will not fit at all or will deform the box. Books which are smaller than can be accommodated by a box either require customized padding or else the books are jogged within the box during shipping and hence are subject to damage. This leads to the packager needing a large inventory of different box sizes for shipping books of varying sizes. The present invention provides a carton which can effectively serve a large range of book sizes. The invention provides a carton for packing books and other similar flat, rectangular items which allows for variations in the size of the packaged product and yet provides a cushioned retention of the product without changing the carton size.

SUMMARY OF THE INVENTION

Figure 3:
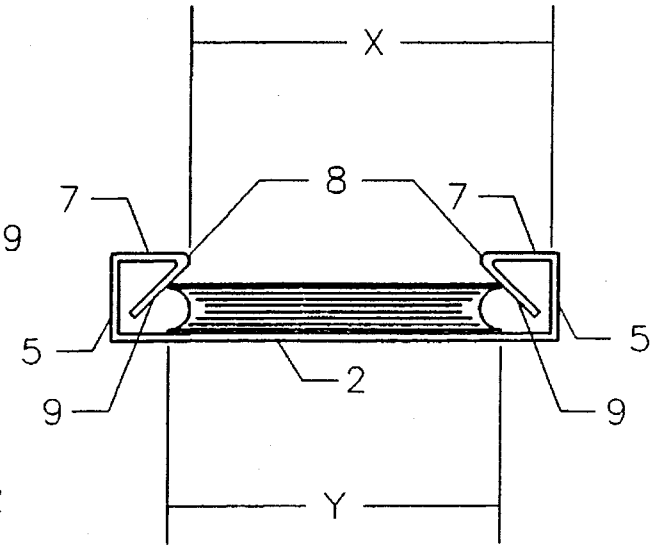
FIG. 3 is an elevational view of a partly erected box construction showing hinged spring panels in position prior to being closed.

The invention provides an article for forming a box construction which comprises:

i) a generally rectangular central panel of flexible sheet material having a length and a width defining two longitudinal and two transverse ends; and ii) a pair of side panels of flexible sheet material, each hingedly joined to one of said longitudinal ends at first fold lines which extend a distance the entire width between said side panels and the central panel, each of said side panels having second and third fold lines, each parallel to and spaced from said first fold line and which extend the entire width of said side panels; and iii) a top panel of flexible sheet material hingedly joined to one of the transverse ends of the central panel at a fourth fold line which extends a distance the entire length at the interface of said top panel and the central panel, said top panel having fifth and sixth fold lines each parallel to and spaced from said fourth fold line and which extends the entire length of said top panel; and at least one of (a) and (b):

(a) said top panel having a seventh fold line parallel to and spaced from said sixth fold line and which extends the entire length of said top panel;

(b) a closure panel of flexible sheet material hingedly joined to a second of the transverse ends of the central panel at an eighth fold line which extends a distance the entire length at the interface of said closure panel and the central panel parallel to and spaced from said fourth fold line.

The invention also provides a box construction which comprises i) a generally rectangular central panel of flexible sheet material having a length and a width defining two longitudinal and two transverse ends; and ii) a pair of side panels of flexible sheet material, each hingedly joined to one of said longitudinal ends at first fold lines which extend a distance the entire width between said side panels and the central panel, each of said side panels being folded along said first fold lines to position a portion of the side panels into a plane perpendicular to and above the plane of said central panel; each of said side panels being folded along the second fold lines to position a portion of the side panels into a plane parallel to, over, and spaced from said central panel; each of said side panels being folded along said third fold lines to position a end portion of the side panels inwardly toward said side and central panels, said end portion being capable of leaf spring engagement with an article, when an article is disposed within the box construction;

iii) a top panel of flexible sheet material hingedly joined to one of the transverse ends of the central panel at a fourth fold line which extends a distance the entire length at the interface of said top panel and the central panel, said top panel being folded along said fourth fold line to position a portion of the top panel into a plane perpendicular to and above the plane of said central panel; said top panel being folded along a fifth fold line to position a portion of the top panel into a plane parallel to, over, and spaced from said central panel; said top panel being folded along said sixth fold line to position a portion of the top panel into a plane perpendicular to and adjacent to said central panel; and at least one of (a) and (b):

(a) said top panel being folded along a seventh fold line to position a portion of the top panel into a plane parallel to and under said central panel;

(b) a closure panel of flexible sheet material being hingedly joined to and folded at a second of the transverse ends of the central panel at an eighth fold line which extends a distance the entire length at the interface of said closure panel and the central panel parallel to and spaced from said fourth fold line.

The invention also provides a method of forming a box construction which comprises:

a) providing the above article;

b) folding each of said side panels along said first fold lines to position the side panels into a plane perpendicular to and above the plane of said central panel; folding each of said side panels along the second fold lines to position a portion of the side panels into a plane parallel to, over, and spaced from said central panel; folding each of said side panels along said third fold lines to position a end portion of the side panels inwardly toward said side and central panels such that said end portions are capable of a leaf spring engagement with an article, when an article is disposed within the box construction;

c) folding the top panel along the fourth fold line to position of the top panel into a plane perpendicular to and above the plane of said central panel; folding said top panel along the fifth fold line to position a portion of the top panel into a plane parallel to, over, and spaced from said central panel; folding said top panel along said sixth fold line to position a portion of the top panel into a plane perpendicular and adjacent to said central panel; and performing at least one of steps (I) and (II):

(I) folding said top panel along said seventh fold line to position a portion of the top panel under said central panel; and (II) folding a closure panel of flexible sheet material which is hingedly joined to a second of the transverse ends of the central panel at an eighth fold line which extends a distance the entire length at the interface of said closure panel and the central panel parallel to and spaced from said fourth fold line; and d) adhering the top panel to one or more of said central panel said closure panel and said side panels.

DETAILED DESCRIPTION OF THE PREFERRED EMBODIMENT

Figure 1:
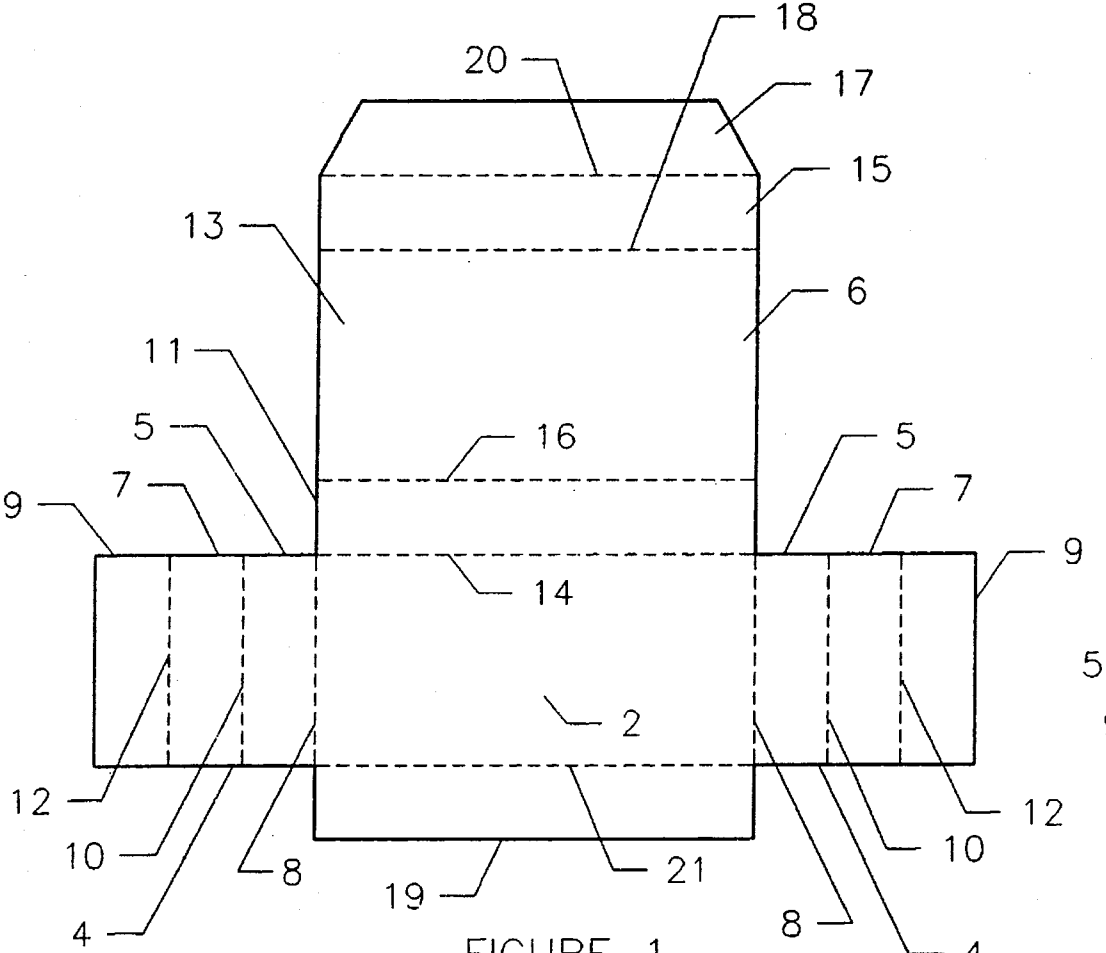
FIG. 1 is a plan view of a flattened member which forms the inventive box structure.

The box construction of the present invention comprises a central panel 2 and a pair of side panels 4 as shown in FIG. 1. The central panel 4 is generally rectangular and has a length and a width defining two longitudinal and two transverse ends and provides a floor to the box. Side panels 4 are of approximately the same size. Side panels 4 are each hingedly joined to one of the longitudinal ends at first fold lines 8 which extend a distance the entire width between the side panels 4 and the central panel 6. Each of the side panels 4 have second and third fold lines 10 and 12 respectively which are each parallel to and spaced from the first fold line 8, and which extend the entire width of the side panels. These folds provide wall members 5, top side panels 7, and retention or spring panels 9. A top panel 6 of flexible sheet material is hingedly joined to one of the transverse ends of the central panel at a fourth fold line 14 which extends the entire length of the intersection of the top panel 6 and the central panel 2. The top panel has fifth, sixth and optional seventh fold lines 16, 18 and 20 respectively, which are each parallel to and spaced from the fourth fold line 14, and which extends the entire length of the top panel. These folds provide a back panel 11, cover panel 13, front panel 15 and closure panel 17. The dimensions of all panels depend on the size range of the books to be packaged by the carton. Panels 9 are preferably slightly narrower than panels 7. Also shown is an optional cover panel 19 which is hingedly attached to the central panel at an eighth fold line 21. For the construction of the present invention, at least one of panels 17 and 19 must be present. Both may be present if additional reinforcement is desired.

Figure 2:
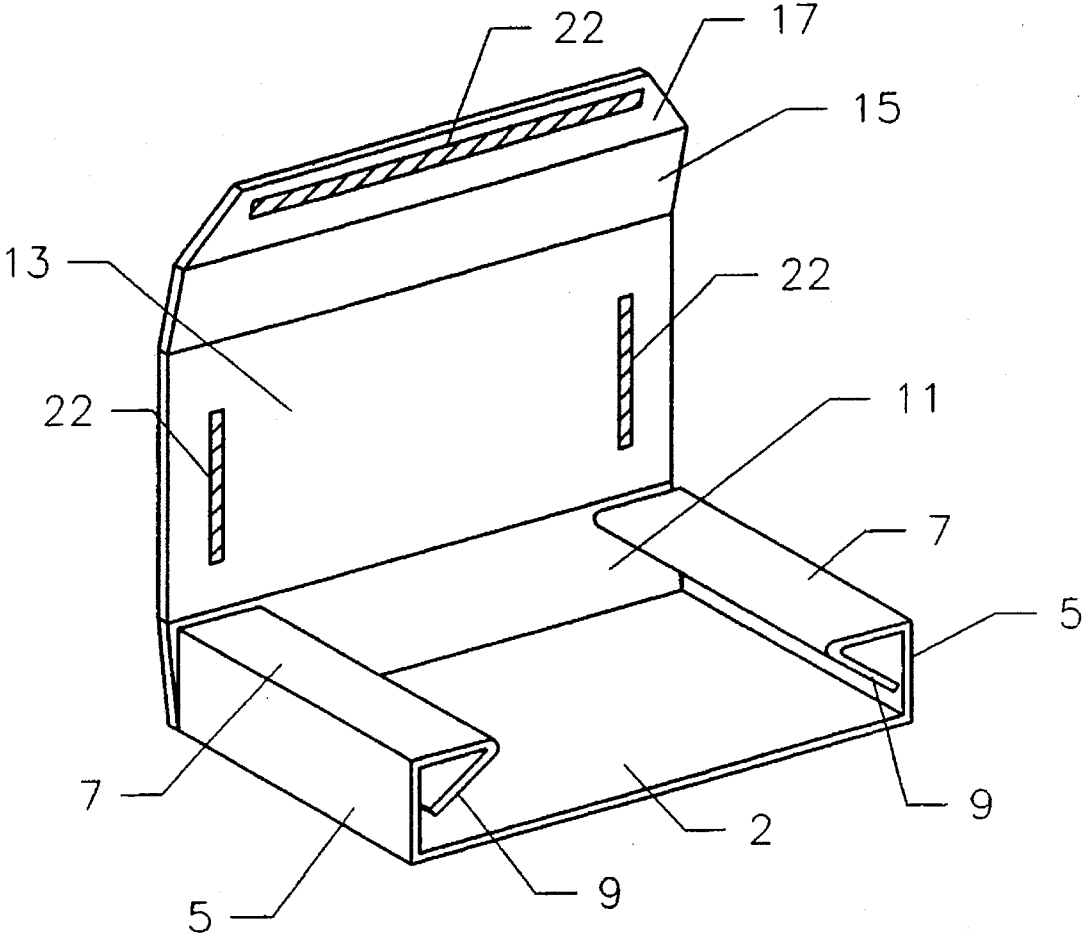
FIG. 2 is a perspective view of a partly erected box structure with some of its panels folded.

As best seen in FIG. 2, as the first step in erecting the preferred box, one folds each of said side panels 4 along first fold lines 8 to position the side panels into a plane perpendicular to and above the plane of the central panel. One then folds each of the side panels along the second fold lines 10 to position a portion of the side panels into a plane parallel to, over, and spaced from the central panel. Folding each of the side panels along the third fold lines 12 positions an end portion of the side panels inwardly toward the side and central panels such that said end portions are effectively leaf springs which can engage with an article when an article is disposed within the box construction. This is best seen in FIG. 3. Folding the top panel along the fourth fold line 14 positions the top panel into a plane perpendicular to and above the plane of the central panel. Folding the top panel along the fifth fold line 16 positions a portion of the top panel into a plane parallel to, over, and spaced from the central panel. Folding the top panel along the sixth fold line 18 positions a portion of the top panel into a plane perpendicular and adjacent to the central panel. In one embodiment, one folds the top panel along the seventh fold line 20 to position a portion of the top panel under the central panel. In an alternate embodiment, closure panel 19 is juxtaposed to panel 15. Either panel 17 is adhered to the under side of central panel 2 or panel 19 is adhered to panel 15 with an adhesive. The top panel 6 is adhered to the central panel or the side panels via adhesives such as at positions 22 as best seen in FIG. 2.

Figure 4:
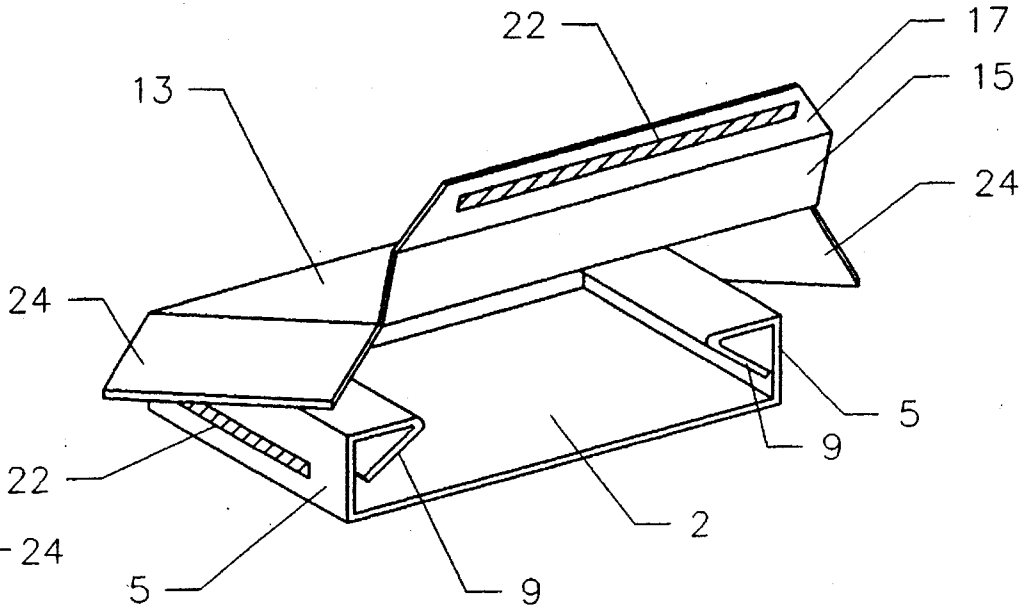
FIG. 4 is a perspective view of an alternate box construction embodiment with additional wing panels in position before being closed.
Figure 5:
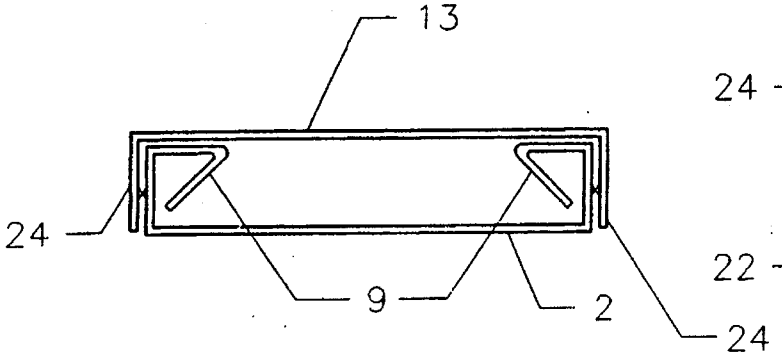
FIG. 5 is an elevational view of a partly erected box construction of FIG. 4 showing additional wing panels in position before being closed.

FIGS. 4 and 5 show an alternate box construction embodiment according to the invention showing additional wing members 24. Wing members 24 are hingedly joined at each of two opposite side edges of the top panel 6 and extend from the fifth to the sixth fold lines, 16 and 18 respectively. The wing members are folded to a position in juxtaposition with the side panels between the first and second fold lines, and they are preferably adhered together at that position.

One important use for the box construction of the invention is for packaging books. In the preferred embodiment, each of the aforementioned panels are composed of flat sheet material such as paperboard, fiberboard, paperboard coated with plastic, or most preferably corrugated cardboard. The material selected and the thickness thereof may vary depending on the cost, weight, and strength characteristics desired. Such materials are well known in the art. Each is preferably manufactured from a flat rectangular sheet of corrugated cardboard and the cut-out portions are knife or die cut by high speed machinery in the configurations shown in FIG. 1 by means well known to the skilled artisan. Likewise, the fold lines may be scored by known methods. The article is of unitary construction capable of being manufactured, shipped, handled and stored in a flat, collapsed configuration as shown in FIG. 1 and yet may be readily folded and adhered closed into the desired box construction either by machinery or an unskilled person in a very short time. Of course, the outer surfaces of the box construction can be provided with any desired indicia such as advertising information, labels, product specifications and the like.

One advantage to the use of the box construction of the invention is that the end portion of the side panels act as leaf springs to provide cushion the book when transported in the box. By free swinging flexible springs along folds 12, books of varying sizes can be accommodated. Due to its inherent spring action, the end of the side panel exerts pressure against the top surface of the book, thus cushioning it from shock both in the horizontal and vertical directions. In the preferred embodiment, the length x is shorter than the length y. In this manner, a book of any length, width or thickness within the interior dimension limits of the carton can be accommodated by the carton while being well protected against damage during shipping. The carton can be erected, loaded and sealed by automated cartoning equipment and machine adjustments for varying book and carton sizes can be eliminated to a great extent.

What is claimed is:

1. An article for forming a box construction which comprises:

i) a generally rectangular central panel of flexible sheet material having a length and a width defining two longitudinal ends and two transverse ends; and ii) a pair of side panels of flexible sheet material, each side panel hingedly joined to one of said longitudinal ends at a first fold line which extends the entire width of the central panel, each of said side panels having a second fold line and a third fold line, each of the second and third fold lines being parallel to and spaced from said first fold lines and which extends the entire width of said side panel; each of said side panels having a free edge parallel to and spaced from its third fold line, wherein the length from the free edge to the third fold line is less than the length from the first fold line to the second fold line; wherein when one of the side panel is folded upward on its first fold line such that a side panel portion from the first fold line to the second fold lines is in a plane perpendicular to the central panel, and when the side panel is folded inward on the second fold line such that a side panel portion from the second fold line to the third fold line is in a plane parallel to the central panel, a side panel portion from the third fold line to the free edge is free to pivot inward about the third fold line, toward but unattached to the central panel; and iii) a top panel of flexible sheet material hingedly joined to one of the transverse ends of the central panel at a fourth fold line which extends the entire length of the central panel, said top panel having fifth and sixth fold lines each parallel to and spaced from said fourth fold line and which extend the entire length of said top panel; and at least one of (a) and (b):

(a) said top panel having a seventh fold line parallel to and spaced from said sixth fold line and which extends the entire length of said top panel;

(b) a closure panel of flexible sheet material hingedly joined to a second of the transverse ends of the central panel at an eighth fold line which extends the entire length of the central panel parallel to and spaced from said fourth fold line.

2. The article of claim 1 which comprises a material selected from the group consisting of paperboard, fiberboard, paperboard coated with plastic, and corrugated cardboard.

3. The article of claim 1 further comprising a pair of wing members one hingedly joined at each of two opposite side edges of the top panel and extending from the fifth to the sixth fold lines.

4. The article of claim 1 further comprising glue between said top panel and at least one of said central panel and said side panels.

5. A box construction which comprises i) a generally rectangular central panel of flexible sheet material having a length and a width defining two longitudinal ends and two transverse ends; and ii) a pair of side panels of flexible sheet material, each side panel hingedly joined to one of said longitudinal ends at a first fold line which extends the entire width of the central panel, each of said side panels being folded along its first fold line to position a portion of the side panel into a plane perpendicular to and above the plane of said central panel; each of said side panels being folded along its second fold line to position a portion of the side panel into a plane parallel to, over, and spaced from said central panel; each of said side panels being folded along its third fold line to position a free end portion, parallel to said third fold line, of the side panel inwardly toward but unattached to said side panel and said central panel, said free end portion being capable of leaf spring engagement with an article, when an article is disposed within the box construction;

iii) a top panel of flexible sheet material hingedly joined to one of the transverse ends of the central panel at a fourth fold line which extends the entire length of the central panel, said top panel being folded along said fourth fold line to position a portion of the top panel into a plane perpendicular to and above the plane of said central panel; said top panel being folded along a fifth fold line to position a portion of the top panel into a plane parallel to, over, and spaced from said central panel; said top panel being folded along a sixth fold line to position a portion of the top panel into a plane perpendicular to and adjacent to said central panel; and at least one of (a) and (b):

(a) said top panel being folded along a seventh fold line to position a portion of the top panel into a plane parallel to and under said central panel;

(b) a closure panel of flexible sheet material being hingedly joined to and folded at a second of the transverse ends of the central panel at an eighth fold line which extends the entire length of the central panel parallel to and spaced from said fourth fold line.

6. The box construction of claim 5 further comprising a pair of wing members, one hingedly joined at each of two opposite side edges of the top panel and extending from the fifth to the sixth fold lines, said wing members being folded to a position in juxtaposition with said side panels between said first and second fold lines.

7. The box construction of claim 6 further comprising glue between said pair of wing members and said side panels.

8. The box construction of claim 7 further comprising glue between said top panel and at least one of said central panel and said side panels.

9. The box construction of claim 5 further comprising glue between said top panel and at least one of said central panel and said side panels.

10. The box construction of claim 5 which comprises a material selected from the group consisting of paperboard, fiberboard, paperboard coated with plastic, and corrugated cardboard.

11. A method of forming a box construction which comprises:

a) providing an article which comprises:

i) a generally rectangular central panel of flexible sheet material having a length and a width defining two longitudinal ends and two transverse ends; and ii) a pair of side panels of flexible sheet material, each side panel hingedly joined to one of said longitudinal ends at a first fold line which extends the entire width of the central panel, each of said side panels having a second fold line and a third fold line, each of the second and third fold lines is parallel to and spaced from said first fold line and extends the entire width of said side panel; and iii) a top panel of flexible sheet material hingedly joined to one of the transverse ends of the central panel at a fourth fold line which extends the entire length of the central panel, said top panel having a fifth fold line a sixth fold line and a seventh fold line each parallel to and spaced from said fourth fold line and extends the entire length of said top panel; and at least one of (a) and (b):

(a) said top panel having a seventh fold line parallel to and spaced from said sixth fold line and which extends the entire length of said top panel;

(b) a closure panel of flexible sheet material hingedly joined to a second of the transverse ends of the central panel at an eighth fold line which extends the entire length of the central panel parallel to and spaced from said fourth fold line;

b) folding each of said side panels along its first fold line to position the side panel into a plane perpendicular to and above the plane of said central panel; folding each of said side panels along its second fold line to position a portion of the side panel into a plane parallel to, over, and spaced from said central panel; folding each of said side panels along its third fold line to position a free end portion, parallel to said third fold line, of the side panel inwardly toward but not attaching to said side panel and said central panel such that said free end portion is capable of a lead spring engagement with an article, when an article is disposed within the box construction;

c) folding the top panel along the fourth fold line to position the top panel into a plane perpendicular to and above the plane of said central panel; folding said top panel along the fifth fold line to position a portion of the top panel into a plane parallel to, over, and spaced from said central panel; folding said top panel along said sixth fold line to position a portion of the top panel into a plane perpendicular and adjacent to said central panel; and performing at least one of steps (I) and (II):

(I) folding said top panel along said seventh fold line to position a portion of the top panel under said central panel; and (II) folding a closure panel of flexible sheet material which is hingedly joined to a second of the transverse ends of the central panel at an eighth fold line which extends the entire length of the central panel parallel to and spaced from said fourth fold line; and d) adhering the top panel to at least one of said central panel, said closure panel and said side panels.

12. The method of claim 11 wherein said adhering is done with one of a pressure sensitive adhesive, a pressure sensitive adhesive tape, a hot melt glue and a band.

13. The method of claim 11 wherein the article further comprises a pair of wing members one hingedly joined at each of two opposite side edges of the top panel and extending from the fifth to the sixth fold lines, and folding said wing members to a position in juxtaposition with said side panels between said first and second fold lines.

14. The method of claim 13 further comprising adhering said wing members to said side panels.

15. The method of claim 14 wherein said adhering is done with one of a pressure sensitive adhesive, a pressure sensitive adhesive tape, a hot melt glue and a band.

16. The method of claim 11 wherein the article comprises a material selected from the group consisting of paperboard, fiberboard, paperboard coated with plastic, and corrugated cardboard.

* * * * *